US009220974B2

(12) United States Patent
Jackson

(10) Patent No.: US 9,220,974 B2
(45) Date of Patent: Dec. 29, 2015

(54) INSTANT GAME TICKET

(71) Applicant: Kathleen Nylund Jackson, Scituate, MA (US)

(72) Inventor: Kathleen Nylund Jackson, Scituate, MA (US)

(73) Assignee: PRECEDENT GAMING, Scituate, MA (US)

( * ) Notice: Subject to any disclaimer, the term of this patent is extended or adjusted under 35 U.S.C. 154(b) by 58 days.

(21) Appl. No.: 14/120,712

(22) Filed: Jun. 19, 2014

(65) Prior Publication Data

US 2014/0375045 A1 Dec. 25, 2014

Related U.S. Application Data

(60) Provisional application No. 61/956,962, filed on Jun. 20, 2013.

(51) Int. Cl.
*A63F 3/06* (2006.01)
*G07F 17/32* (2006.01)

(52) U.S. Cl.
CPC ..... *A63F 3/0605* (2013.01); *A63F 3/0665* (2013.01); *G07F 17/32* (2013.01); *G07F 17/329* (2013.01); *Y10S 283/903* (2013.01)

(58) Field of Classification Search
CPC ..... A63F 3/0665; Y10S 283/903
USPC ..... 283/903; 273/139; 463/17
See application file for complete search history.

(56) References Cited

U.S. PATENT DOCUMENTS

| | | | | |
|---|---|---|---|---|
| 6,159,274 | A * | 12/2000 | Sato | B42D 15/025 283/903 |
| 6,761,633 | B2 | 7/2004 | Riendeau et al. | |
| 6,926,273 | B1 | 8/2005 | Vancura | |
| 7,410,168 | B2 | 8/2008 | Gumina | |
| 7,429,044 | B2 | 9/2008 | O'Brien | |
| 7,431,646 | B2 | 10/2008 | Jackson | |
| 7,481,432 | B2 | 1/2009 | Feola | |
| 7,497,778 | B2 | 3/2009 | Bozeman | |
| 2003/0173739 | A1 * | 9/2003 | Stewart | A63F 3/0665 283/903 |
| 2007/0187888 | A1 | 8/2007 | Dures et al. | |
| 2007/0262520 | A1 | 11/2007 | Martineck | |
| 2008/0132314 | A1 | 6/2008 | Robb et al. | |
| 2009/0098922 | A1 | 4/2009 | Cummings et al. | |
| 2009/0253481 | A1 | 10/2009 | Honour | |

* cited by examiner

*Primary Examiner* — Kyle Grabowski

(57) ABSTRACT

A method of playing an instant scratch game lottery ticket. Each ticket provides a printed grid comprised of adjoining edge features that provide at least two enclosed symbol areas. Each edge feature is labeled by a unique indicium and covered in a transparent film. Each enclosed symbol area contains a prize symbol that is covered in an opaque film. Also provided are player indicia covered with an opaque film that is removed to reveal the player indicia. The transparent film covering each labeled edge feature that matches a player indicium is then removed. If the edge features that have been removed are adjoined and provide a fully enclosed area, the prize symbol(s) in the fully enclosed area is/are revealed by removing the opaque film covering the prize symbol(s). Any revealed prizes are provided as an award to the player.

5 Claims, 5 Drawing Sheets

INSTANT GAME TICKET

RELATED APPLICATION DATA

This application claims priority from U.S. Provisional Patent Application Ser. No. 61/956,962, filed Jun. 20, 2013, and having the Title INSTANT GAME TICKET.

BACKGROUND OF THE INVENTION

1. Field of the Invention

The present invention relates to an instant game ticket (otherwise known in the art as a "scratch ticket"). The invention further relates to lottery gaming wherein the physical instant game ticket may be purchased and verified at a lottery agent location or other suitable locations, the ticket utilizing a gameplay that provides scratchable areas that may form enclosed areas providing scratchable prize areas that provide prize symbols. In a separate embodiment, the instant scratch ticket may be electronic and displayed on a monitor screen.

2. Background of the Art

For nearly 50 years, instant game tickets, or scratch tickets as in known in the art, have been offered for sale as part of city, state, and national lotteries. These tickets typically have an array of winning numbers and an array of player numbers, each concealed with a removable film. The player scratches off the film to reveal the numbers. If a player number matches a winning number, a prize is won.

Scratch ticket games are provided wherein a predetermined number of tickets are printed, each ticket providing either a losing result or a winning result. The amount of tickets with losing results is predetermined, as are the number of tickets with winning results. Also predetermined is the number of tickets for each individual win amount. The total amount of awards of the winning tickets will be less than the total cost of all tickets in the game. For instance, a total of 90,720,000 $5 tickets may be printed and sold. The total ticket sales will be $453,600,000. The total payout to players may be $345,471,000.

Scratch tickets have gained considerable popularity since they provide a near instant gratification; that is, the result can be determined in mere seconds. A drawback of the gameplay, however, is that some players feel it is too quick. There is virtually hardly any time to build up anticipation and therefore excitement. And the more player excitement, the bigger the chance that players will buy and play the game.

To remedy the scratch-time problem, new versions of the instant ticket have lately been created. For instance, many states now offer a crossword-based game that provides an array of letters that must each be scratched off in a given word grid. Wins are based on the amount of completed words in the grid. Instead of mere seconds to finish, this word-based game can take three or more minutes to complete, all the while building anticipation and hope. As the game progresses, the player becomes aware of which letter or letters will be the most advantageous to obtain, and may root accordingly. Another example of an extended-play ticket incorporates a bingo-based game, in which bingo numbers (B3, I20, N34, G55, O70 for instance) are provided and scratched off in one or more bingo grids on the ticket. This gameplay, too, takes minutes to finish and provides an ever-escalating excitement as more and more bingo numbers are revealed, leading to hopefully winning arrays in the grid.

Various attempts have been made to create new instant games and gameplay in order to increase player participation and excitement.

U.S. Pat. No. 7,497,778 (Bozeman) teaches a word-based lottery game wherein a player buys a ticket with a word or set of words and may win a prize if the outcome of a draw confers a win status to one or more words in the ticket. The draw is a random process for which an outcome is a concatenation of characters and may confer word a winner based upon a rule such as being able to compose the word with the drawn characters.

U.S. Pat. No. 7,481,432 (Feola) describes a method of playing a poker-type scratch ticket game where a scratch ticket has a plurality of two-card, known, starter hands and five unrevealed community cards. A player reveals the community cards. Each starter hand is combined with the community cards to form complete hands. The player is paid a predetermined amount if any of the complete hands is found in a pay table. Optionally, the predetermined amount is based on the rank of the hand. Optionally, there is more than one set of community cards.

U.S. Pat. No. 7,431,646 (Jackson) discloses a method of providing award features and award methods for electronic slot-type wagering machines and video wagering machine base games. The method comprises providing a gaming display area including game areas that may be indicated as enclosed by edge features; displaying within each game area a symbol prior to positioning edge features; randomly positioning edge features on the gaming display area; ceasing positioning of edge features according to rules of the wagering game to a final count of edge features; determining if the final count of edge features enclose symbols according to rules of the wagering game; and determining if any symbols are enclosed by edge features according to the rules of the game to establish a winning event, losing event, or push event in the game.

U.S. Pat. No. 7,429,044 (O'Brien) teaches a scratch-ticket game card simulating an instant Texas Hold'Em Poker game card with multiple chances of winning for a player. The instant game card includes plurality sets of player hands and a set of opponent hands, a set of community cards, and at least two prizes. The player can combine the set of community cards with each set of player hands to form a strongest hand for that set of player hands. The strongest hand for each set of player hands is compared against the strongest hand for the opponent hand. If the player wins, the player wins the prize associated with the winning player hand.

U.S. Pat. No. 7,410,168 (Gumina) discloses a lottery instant win game card simulating a Hold'Em Poker styled card game with multiple chances of winning for a player. The instant game card includes at least two sets of player hands and at least two sets of opponent hands, with at least two sets of community cards, and at least two prizes. The player can combine one set of the player hands with either set of community cards to form a strongest hand for that set of player hands. The strongest player hand is compared against the strongest opponent hand. If the player wins, the player wins the prize associated with that winning player hand.

U.S. Pat. No. 6,926,273 (Vancura) teaches a seal card game having a number of play areas, with each play area having a hidden symbol. One of the hidden symbols on the ticket is a directional symbol. The other hidden symbols are end of game symbols. The player has one opportunity to uncover a hidden symbol in only one play area. Uncovering an end of game symbol ends the game. Uncovering the directional symbol entitles the player to uncover one or more authorized award areas within a topological area. Upon redeeming the ticket, the player receives the authorized awards in the topological area based performance of a mathematical operation on values revealed in the authorized award areas.

U.S. Pat. No. 6,761,633 (Riendeau, et al.) teaches an online game of chance and methods of conducting and playing the game on a virtual instant ticket. The game is based on a map having multiple branches and nodes, where a desired path is selected by clicking on the branch or node as play progresses between a starting point and multiple finishing points. Each available branch or node that is selected results in a prize value being increased, decreased, or a token being awarded for later use in the game. In a single player mode, a final prize is awarded to the player. In multiple player modes, the final prize is divided among the players according to predetermined criteria.

United States Patent Application No. 20090098922 (Cummings, et al.) describes a lottery game using tickets in which the tickets bear concealed numbers that may be exposed by the player after purchase to determine the winning number of that lottery ticket and after the player selects the numbers upon which the player is betting to win. In one embodiment the concealed numbers comprise the winning number for that ticket to be matched by those selected by the player.

United States Patent Application No. 20090253481 (Honour) teaches a lottery ticket game providing the player multiple sequential predetermined outcomes in which the player may choose to continue or terminate game play at a plurality of continuation points whereas the redemption value of the ticket at each continuation point is determined at the time in which the ticket is printed or activated. The lottery game represented by the lottery ticket includes a game-ending termination point in which a) the redemption value of the ticket is zero, b) the redemption value of the ticket exceeds a predefined jackpot amount, or c) the number of continuation points exceeds a value predetermined for the game.

United States Patent Application No. 20080132314 (Robb, et al.) a method for conducting a dynamic lottery game that includes determining an opening entry, dispensing a lottery game ticket, and dispensing a continuation ticket.

United States Patent Application No. 20070262520 (Martineck) describes a lottery instant-game ticket and method of making same. On a substrate is placed a first set of game indicia including a first set of game symbols, and a second set of indicia larger than the first set of game indicia and including a second set of game symbols, and includes any winning symbol. A subset of the second set of game indicia with each symbol includes a non-winning indicator. The first set and second of game indicia are covered with a removable covering, with the covering having position indicators positioned substantially over each of the first set of game indicia, and identical game symbols positioned substantially over a corresponding identical game symbol of the second set of game indicia such that removal of the identical game symbol reveals the identical game symbol of the second set of game indicia and any non-winning indicator, if present.

United States Patent Application No. 20070187888 (Dures, et al.) discloses a lottery game card for playing a Sudoku-themed game. The lottery game card includes a plurality of squares arranged in rows and columns, each square having a symbol. Selected squares are covered with a removable material. The lottery game card also includes a plurality of prize indicators, each prize indicator being associated with a predefined pattern of squares. Upon removing of covered squares by a player, if symbols in the plurality of squares match a predefined pattern, the player wins a prize associated with the predefined pattern.

Each of the references discussed in this text art are incorporated herein in their entirety for all purposes.

It is an ever-increasing challenge to provide players with new and enticing gameplay features that will stimulate player interest and increase participation in instant lottery games. It would be advantageous to provide inventive elements for an instant scratch ticket that requires minutes, not just seconds, to play, and that creates an ever-increasing level of anticipation not seen in a typical scratch ticket game.

SUMMARY OF THE INVENTION

The present invention discloses a method of playing a lottery instant scratch ticket game comprised of a plurality of tickets, in which the physical ticket provides a printed grid comprised of adjoining edge features that provide at least two enclosed symbol areas. Each edge feature is designated or labeled by a unique indicium, preferably a number and/or a letter. The said labeled edge features are covered in a transparent removable film. Adjoining edge features provide enclosed symbol areas that each comprise a prize symbol that is covered in an opaque removable film. Also provided in a separate area on the instant scratch ticket is a printed box containing at least three player indicia (herein described as "YOUR EDGES") that are used to label the edge features. The said box with the "YOUR EDGES" symbols is covered with an opaque removable film. Play instructions are also printed on the ticket. Upon purchase of the instant scratch ticket, the player is prompted according to the play instructions to first remove or "scratch off" the opaque film covering the said box, thereby revealing the "YOUR EDGES" symbols. The player is then prompted to remove or "scratch off" the transparent film covering each labeled edge feature that matches a revealed "YOUR EDGES" symbol. If the edge features that have been scratched off are adjoined and provide a fully enclosed area, the prize symbol(s) in the enclosed area is/are revealed by scratching off the opaque film covering the prize symbol(s). Any revealed prizes are provided as a win to the player.

DETAILED DESCRIPTION OF THE INVENTION

Figure 1:
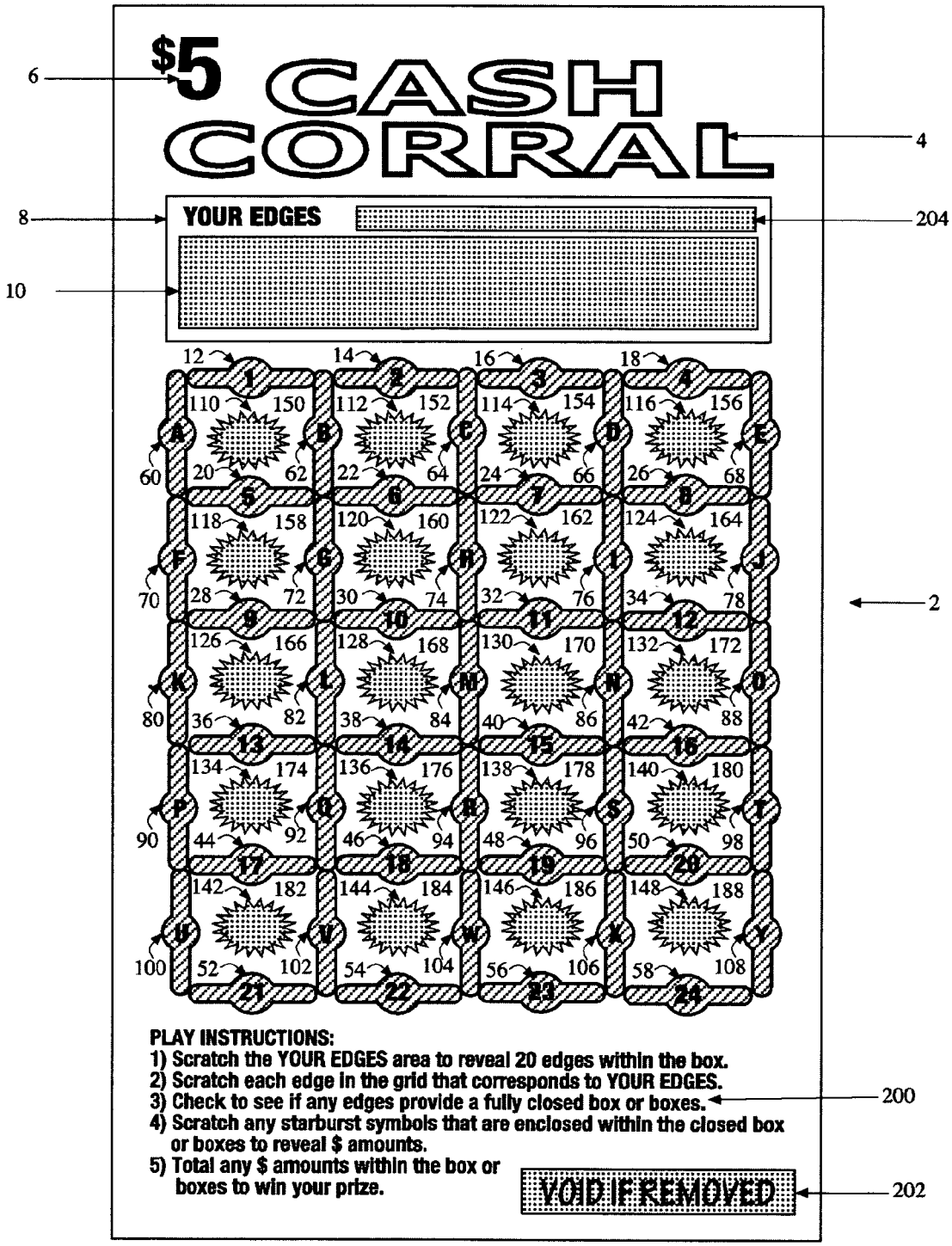
FIG. 1 shows an instant scratch ticket containing the game elements for a game utilizing the game technology described herein.

The present invention discloses a lottery game in which a plurality of instant scratch tickets is provided. The present invention describes the physical lottery instant scratch ticket, and the method of play thereof. A wager of cash, credits or non-monetary points may be required to play the game. Preferably, the denomination and name of the game are shown on the ticket. Also preferably, a printed security code is provided and is concealed underneath an opaque film. The said security code provides an encryption that guarantees that the ticket is valid and maintains the authenticity of the instant game ticket. The ticket provides a printed grid comprised of adjoining edge features that comprise at least two enclosed symbol areas. The at least two enclosed symbol areas may be comprised of having at least one edge feature that is a common edge feature, or may be two separate enclosed areas. The edge features may form at least a triangular shape, but preferably a square or rectangular shape. Each edge feature is designated or labeled by a specific unique symbol, preferably a number and/or a letter. The said labeled edge features are covered in a transparent removable film so that each specific unique symbol is clearly visible. Each enclosed symbol area within the adjoining edge features may comprise a prize symbol, although the symbol areas may include blank spaces instead of prize symbols. The prize symbols may include cash or credit amounts, non-monetary point amounts, or icons providing prizes such as cars, vacations, houses, and the like. The cash, credit or non-monetary point amounts may or may not include zero-value prizes. The said prize symbol areas are covered in an opaque removable film. Also provided in a separate area on the instant scratch ticket is a printed boxed area containing at least three of the unique symbols used to label the edge features, herein described as the player's indicia or "YOUR EDGES". The said boxed area with the "YOUR EDGES" symbols is covered with an opaque removable film. Play instructions are also printed on the ticket. Upon purchase of the instant scratch ticket at preferably a verified lottery agent or ticket outlet, the player is prompted according to the play instructions to first remove or "scratch off" the opaque film covering the boxed area, thereby revealing the "YOUR EDGES" symbols inside the boxed area. The player is then prompted to remove or "scratch off" the transparent film covering each labeled edge feature that matches a revealed "YOUR EDGES" symbol. If the edge features that have been scratched off are adjoined and provide a fully enclosed area, the prize symbol(s) in the enclosed area is/are revealed by scratching off the opaque film covering the prize symbol(s). Any revealed prizes are provided as a winning amount to the player. In order to verify the said winning amount, there is provided is a separate verification code that is revealed by scratching off the overlaying opaque film.

Any winning ticket (according to the verification code) is then reverified by processing the ticket through a computer terminal comprised of at least a ticket input device and a computer processor at a lottery agent location or other suitable locations.

Reference to the Figures will assist in further understanding of the practice of the present invention.

FIG. 1 illustrates a preferred embodiment of the present invention, providing the elements of present invention that afford the specific gameplay thereof. A physical lottery instant game ticket 2 is provided, comprising a game ticket name 4, the denomination of the ticket 6, a contained area 8 labeled "YOUR EDGES" that provides a boxed area 10 that contains player indicia. The boxed area 10 is covered with an opaque removable film (as illustrated by a dot pattern), so as to conceal the player indicia underneath. The concealed player indicia comprise twenty symbols that match labeled edge features described below. Also provided on the game ticket 2 is a grid providing labeled horizontal edge features 12, 14, 16, 18, 20, 22, 24, 26, 28, 30, 32, 34, 36, 38, 40, 42, 44, 46, 48, 50, 52, 54, 56, 58 and labeled vertical edge features 60, 62, 64, 66, 68, 70, 72, 74, 76, 78, 80, 82, 84, 86, 88, 90, 92, 94, 96, 98, 100, 102, 104, 106, 108. Each labeled edge feature is covered with a transparent removable film (as illustrated by a diagonal line pattern) that allows the player to remove or "scratch off" the transparent film according to the rules of the game. The labeled edge features 12, 14, 16, 18, 20, 22, 24, 26, 28, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, 100, 102, 104, 106, 108 provide enclosed symbol areas 150, 152, 154, 156, 158, 160, 162, 164, 166, 168, 170, 172, 174, 176, 178, 180, 182, 184, 186, 188. For example, edge features labeled 1, A, B, 5 provide the enclosed symbol area 150. Each of the twenty enclosed symbol areas shown provides a prize area wherein a prize symbol is printed. Each prize area is covered with an opaque removable film (dot pattern) in the shape of a starburst symbol 110, 112, 114, 116, 118, 120, 122, 124, 126, 128, 130, 132, 134, 136, 138, 140, 142, 144, 146, 148 so as to conceal the printed prize symbol underneath. For example, the enclosed symbol area 150 provides the starburst symbol 110 that conceals a prize symbol underneath. Also shown are the gameplay instructions 200, a security code area 202 covered by an opaque removable film (dot pattern) that may be removed only by at a lottery terminal or by a verified lottery agent, and a verification code area 204 covered by an opaque removable film (dot pattern).

Figure 2:
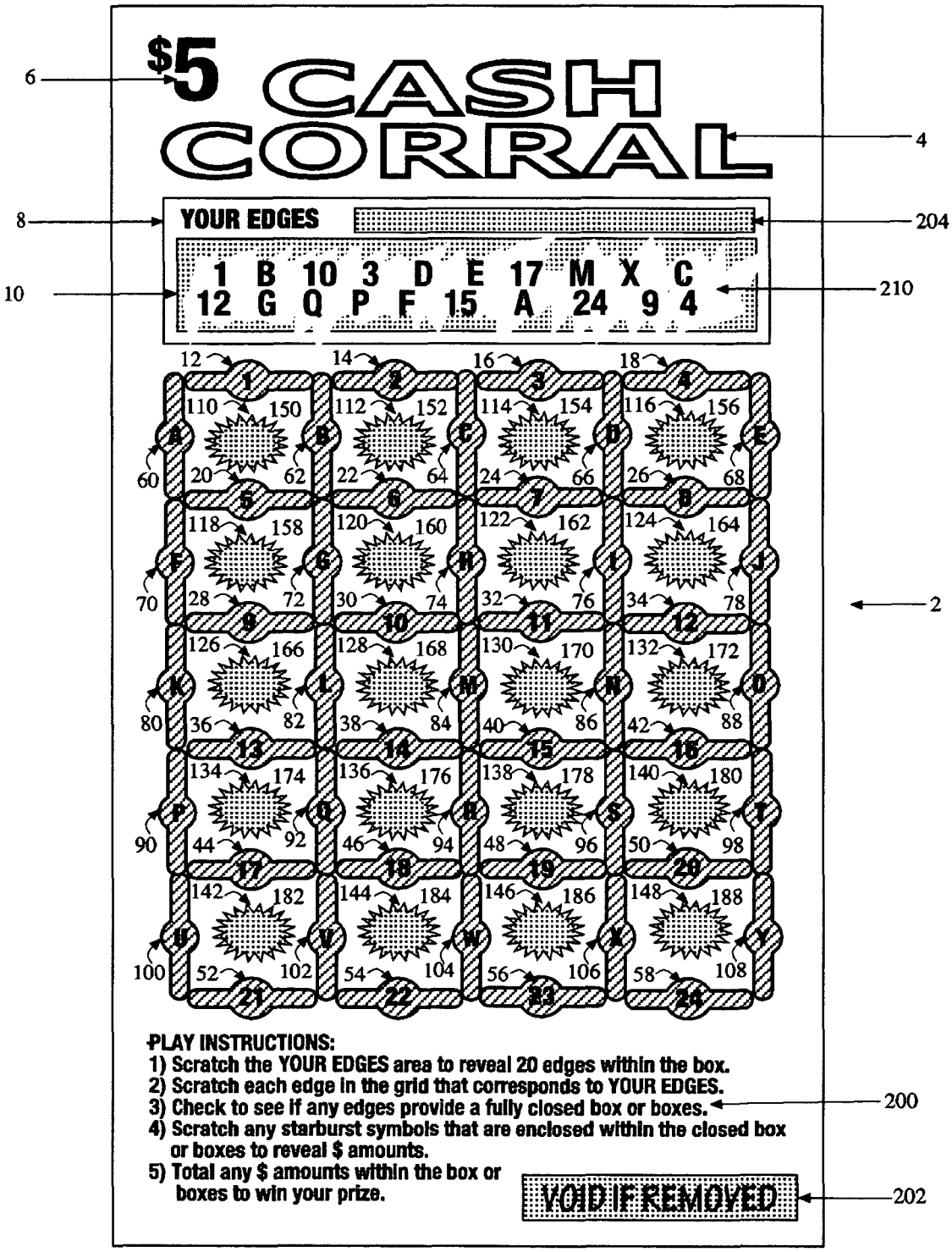
FIG. 2 shows the "YOUR EDGES" symbols being revealed by scratching off the opaque film covering the box containing the "YOUR EDGES" symbols.

FIG. 2 shows the elements of FIG. 1 wherein the player, according to the gameplay instructions 200, has removed or "scratched off" the opaque film concealing the "YOUR EDGES" boxed area 10, revealing twenty letters/numbers (1, B, 10, 3, D, E, 17, M, X, C, 12, G, Q, P, F, 15, A, 24, 9, 4) 210, comprising the player indicia ("YOUR EDGES") that match twenty of the labeled edge features 12, 14, 16, 18, 20, 22, 24, 26, 28, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, 94, 96, 98, 100, 102, 104, 106, 108.

Figure 3:
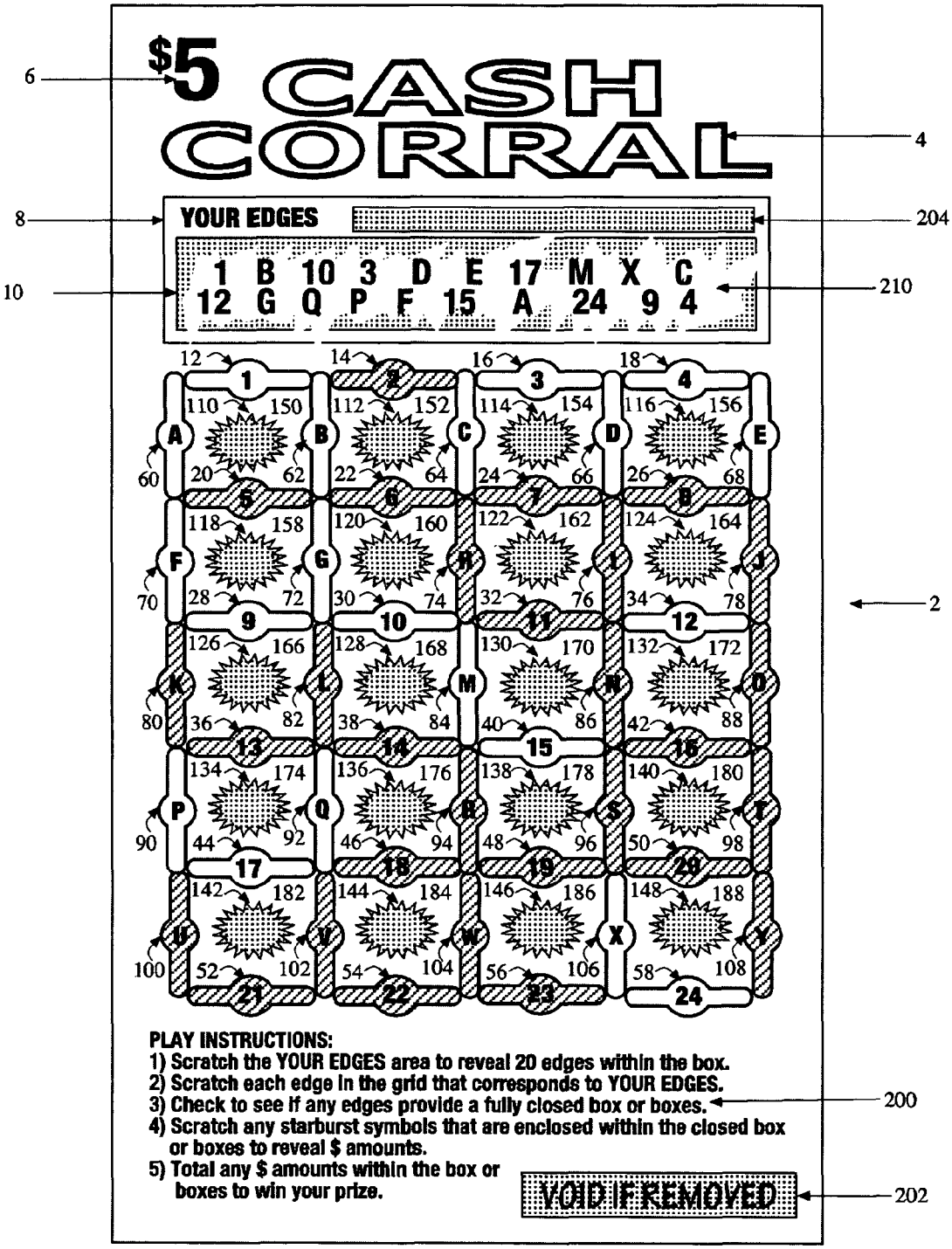
FIG. 3 shows the film covering the labeled edge features that match the "YOUR EDGES" symbols being removed.

FIG. 3 shows the elements of FIG. 2 wherein, according to the gameplay instructions 200, the transparent film covering the labeled edge features that match the player's "YOUR EDGES" is removed or "scratched off", specifically the labeled edge features comprising 1, B, 10, 3, D, E, 17, M, X, C, 12, G, Q, P, F, 15, A, 24, 9, 4. The edge features comprising 1, A, B, F, G, 9 form two enclosed areas 150 and 158 that provide two starburst symbols 110 and 118 that conceal prize symbols underneath.

Figure 4:
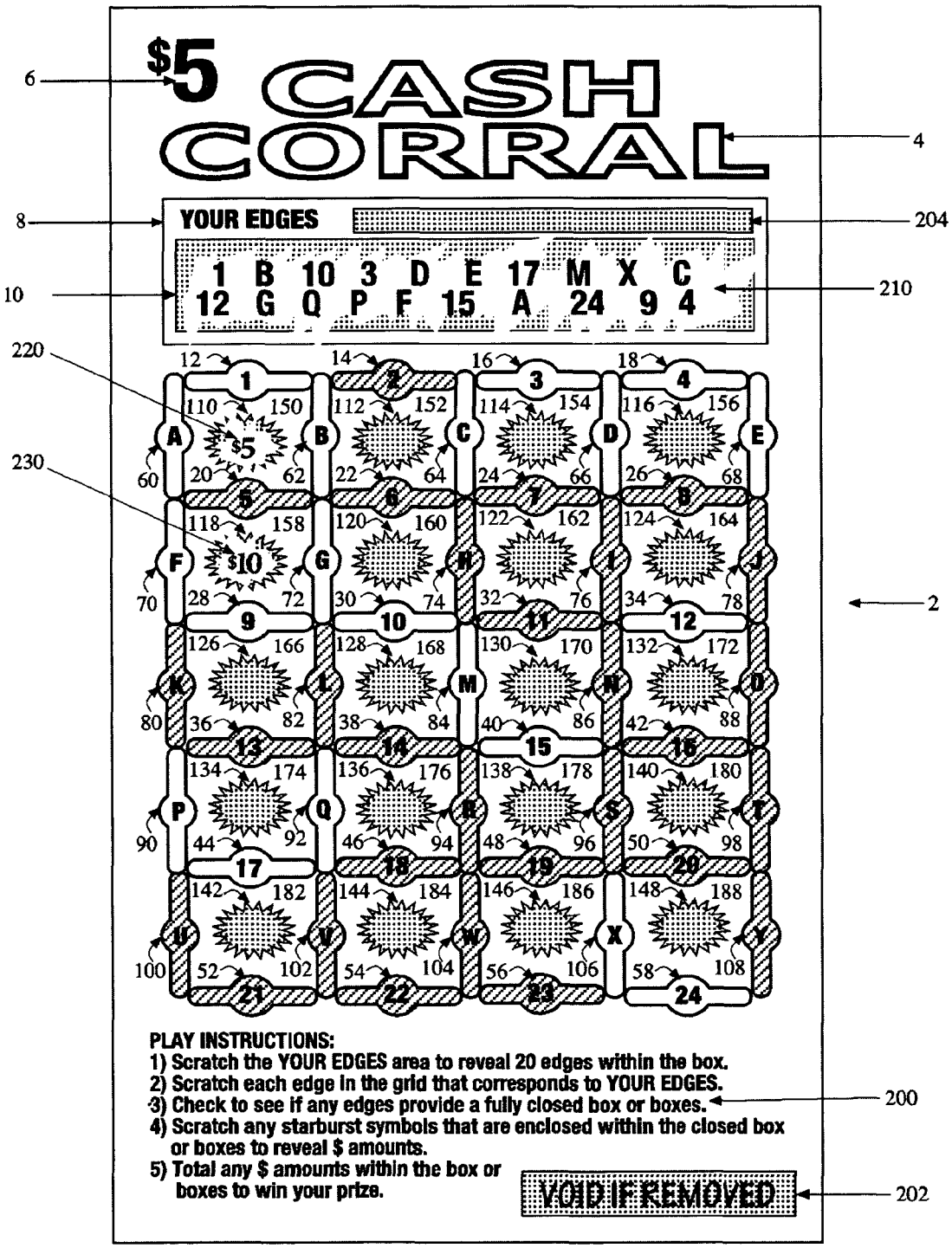
FIG. 4 shows the dollar prize symbols within the enclosed edge features being revealed.

FIG. 4 shows the elements of FIG. 3 wherein, according to the gameplay instructions 200, the concealed prize symbols 220 and 230 are revealed by removing or "scratching off" the starburst-shaped opaque film 110 and 118, providing a $5 win 220 and a $10 win 230.

Figure 5:
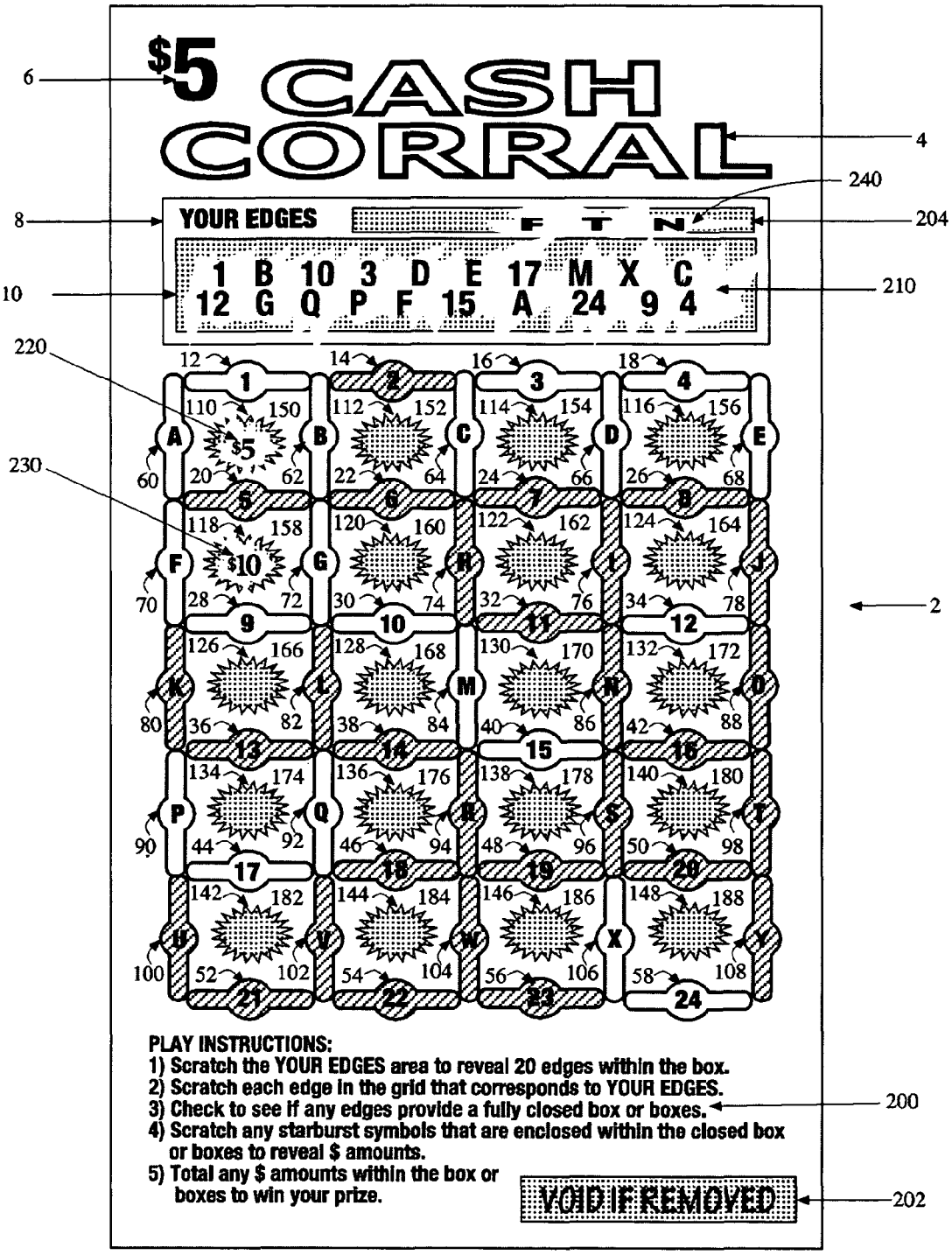
FIG. 5 shows the final win amount being verified.

FIG. 5 shows the $15 win (the values of the wins 220 and 203) being verified by scratching off opaque film over the verification code 204, revealing the verification code "FTN" 240, standing for "FIFTEEN".

It should be appreciated that the present invention may, as opposed to a physical ticket, provide an electronic ticket displayed on an electronic device that comprises at least a monitor screen, an electronic processor, and an input device. The said electronic ticket uses the same basic gameplay as described above in FIGS. 1 through 5 for the physical ticket, but wherein the player may "scratch off" any transparent or opaque "films" by utilizing an input device such as a touch-screen, mouse, button or similar tool. Alternately, the "scratch off" process may be provided by the processor.

Although specific examples and specific win tables have been provided in this discussion, these specifics are intended to be only support for the generic concepts of the invention and are not intended to be absolute limits in the scope of the technology discussed.

What is claimed:

1. A method of conducting a lottery instant scratch ticket game comprising the steps of:

a) providing a plurality of physical scratch tickets;

b) providing a printed grid on each ticket that comprises at least two symbol areas that may be indicated as enclosed by adjoining labeled edge features;

c) wherein each labeled edge feature is covered by a transparent removable film;

d) providing within each enclosed symbol area a prize symbol covered by an opaque film;

e) providing a separate boxed area covered in an opaque film that comprises a plurality of player indicia that may each match a labeled edge feature;

f) removing the opaque film over the player indicia;

g) determining if any labeled edge features match a player indicium;

h) removing the transparent film over each labeled edge feature that matches the player indicium;

i) determining if at least one fully enclosed symbol area is existent as defined by the labeled edge features that match the player indicia;

j) removing the opaque film over all prize symbols within all fully enclosed symbol areas;

k) determining the value of each enclosed prize symbol within each fully enclosed symbol area;

l) determining if the value of the enclosed prize symbol(s) match a verification code; and m) providing the value of the verified prize symbol(s) as an award.

2. The method of claim 1 wherein the value of the verified instant lottery ticket is then reverified by processing the ticket through a redemption terminal comprised of at least a ticket input device and a computer processor.

3. A method of conducting a game that provides an electronic ticket displayed on an electronic device that comprises at least a monitor screen, an electronic processor, and an input device, that comprises the steps of:

a) providing a grid on the electronic ticket that comprises at least two symbol areas that may be indicated as enclosed by adjoining labeled edge features;

b) wherein each labeled edge feature is covered by a transparent removable layer;

c) providing within each enclosed symbol area a prize symbol covered by an opaque layer;

d) providing a separate boxed area covered in an opaque layer that comprises a plurality of player indicia that may each match a labeled edge feature;

e) removing the opaque layer over the player indicia;

f) determining if any labeled edge features match a player indicium;

g) removing the transparent layer over each labeled edge feature that matches the player indicium;

h) determining if at least one fully enclosed symbol area is existent as defined by the labeled edge features that match the player indicia;

i) removing the opaque layer over all prize symbols within all fully enclosed symbol areas;

j) determining the value of each enclosed prize symbol within each fully enclosed symbol area; and k) providing the total value of the prize symbol(s) as an award.

4. The method of claim 3 wherein the player may remove any transparent or opaque layer by utilizing an input device such as a touchscreen, mouse, button or similar tool.

5. The method of claim 3 wherein the processor may function to remove any transparent or opaque layer without player input.

* * * * *